US010998158B1

(12) United States Patent
Lewellen et al.

(10) Patent No.: US 10,998,158 B1
(45) Date of Patent: May 4, 2021

(54) VARIABLE-FOCUS MAGNETOSTATIC LENS

(71) Applicant: Triad National Security, LLC, Los Alamos, NM (US)

(72) Inventors: John Lewellen, Los Alamos, NM (US); Kimberley Nichols, Los Alamos, NM (US); Heather Andrews, Los Alamos, NM (US); Ryan Fleming, Los Alamos, NM (US)

(73) Assignee: Triad National Security, LLC, Los Alamos, NM (US)

( * ) Notice: Subject to any disclaimer, the term of this patent is extended or adjusted under 35 U.S.C. 154(b) by 0 days.

(21) Appl. No.: 16/444,412

(22) Filed: Jun. 18, 2019

Related U.S. Application Data

(60) Provisional application No. 62/688,264, filed on Jun. 21, 2018.

(51) Int. Cl.
*H01J 3/24* (2006.01)
*H01J 3/12* (2006.01)

(52) U.S. Cl.
CPC . *H01J 3/24* (2013.01); *H01J 3/12* (2013.01)

(58) Field of Classification Search
CPC ..... H01J 3/24; H01J 3/12; H01J 3/00; H01J 3/10; H01J 3/14; H01J 3/20
USPC ..... 250/396 R, 397, 396 ML
See application file for complete search history.

(56) References Cited

U.S. PATENT DOCUMENTS 5,397,956 A * 3/1995 Araki ..... H01J 37/077 313/231.31
2004/0195521 A1* 10/2004 Alekseev ..... H01J 27/143 250/423 R

OTHER PUBLICATIONS

Dassault Systemes Computer Simulation Technology website available at https://www.cst.com/ (last accessed Jun. 18, 2019).
Evgenya I. Simakov et al., "Diamond Field Emitter Array Cathodes and Possibilities of Employing Additive Manufacturing for Dielectric Laser Accelerating Structures," in API Conf. Proc. 1812 (AAS2017), National Harbor, MD (Aug. 2016).
Fleming et al., "A simple variable focus lens for field emitter cathodes," in Proc. AAC' 18, Breckenridge, Colorado, US, Aug. 2018, pp. 1-5.
H.L. Andrews et al., "Current experimental work with diamond field-emitter array cathodes," in Proc. 38th Int'l Free-Elect. Laser Conf. (FEL'17), Santa Fe, NM (Aug. 2017).
Heather Andrews et al., "An investigation of electron beam divergence from a single DFEA emitter tip," presented at IPAC'18, Vancouver, Canada, paper THPML007 (Apr.-May 2018).
K. Halbach et al., "7.2.8—Permanent Magnet Elements," in Handbook of Accelerator Physics and Engineering, 2nd Ed., A.W. Chau et al., Ed., Hackensack, NJ, USA: World Scientific, pp. 607-614 (2012).
Kim et al., "Fabrication of Micron-Scale Diamond Field Emitter Arrays for Dielectric Laser Accelerators," in Proc. AAC'18, Breckenridge, Colorado, US, Aug. 2018, pp. 1-3.
PCT Mathcad website available at https://www.ptc.com/en/products/Mathcad (last accessed Jun. 18, 2019).
(Continued)

*Primary Examiner* — Nicole M Ippolito
(74) *Attorney, Agent, or Firm* — LeonardPatel P.C.; Michael Aristo Leonard, II; Sheetal Suresh Patel

(57) ABSTRACT

Variable-focus solenoidal lenses for charged particle beams with integrated emittance filtering are disclosed. The emittance may be controlled via selection of collimating irises. The focal length may be changed by altering the spacing between two permanent ring magnets.

19 Claims, 16 Drawing Sheets

(56) References Cited

OTHER PUBLICATIONS

Poisson Superfish website available at https://laacg.lanl.gov/laacg/services/download_sf.phtml (last accessed Jun. 18, 2019).
Pulsar Physics General Particle Tracer (GPT) website available at http://www.pulsar.nl/ (last accessed Jun. 18, 2019).
Thorlabs website available at https://www.thorlabs.com/ (last accessed Jun. 18, 2019).

* cited by examiner

200

300

600

800

900

1200

1300

VARIABLE-FOCUS MAGNETOSTATIC LENS

CROSS-REFERENCE TO RELATED APPLICATION

This application claims the benefit of U.S. Provisional Patent Application No. 62/688,264 filed Jun. 21, 2018. The subject matter of this earlier-filed application is hereby incorporated by reference in its entirety.

STATEMENT OF FEDERAL RIGHTS

The United States government has rights in this invention pursuant to Contract No. 89233218CNA000001 between the United States Department of Energy and Triad National Security, LLC for the operation of Los Alamos National Laboratory.

FIELD

The present invention generally relates to lenses, and more particularly, to variable-focus magnetostatic lenses for charged particle beams.

BACKGROUND

Typically, lenses for focusing charged particle beams include electromagnets. However, electromagnets consume power and are only as stable as their power supply, which must be on in order for the electromagnets to operate. Electromagnets also create heat, and in certain applications, this heat can be problematic to remove. Furthermore, while an electromagnet generates a magnetic field in proportion to the current supplied to the magnet, the power consumed, and heat generated, is proportional to the square of the current. Thus, generating strong magnetic fields with electromagnets can result in very high heat loads, and the heat load will change with the required magnetic field.

For a given lens size, a permanent magnet-based focusing system may have a smaller physical size than an electromagnet-based system of similar focusing strength. Therefore, a permanent-magnet based focusing system for charged particle beams may be particularly advantageous in situations wherein electrical power, physical size, or waste heat removal are difficult to perform. A particular example is the case of satellites, which are highly constrained in power, size, weight, and waste heat removal. Other examples include, but are not limited to, portable electron beam systems or a charged-particle beam transport system intended to be operated in a large vacuum chamber.

However, lenses for charged particle beams based on permanent magnets are typically mechanically complex, often provide a fixed focal length, and are expensive to fabricate. Accordingly, an improved permanent magnet lens may be beneficial.

SUMMARY

Certain embodiments of the present invention may provide solutions to the problems and needs in the art that have not yet been fully identified, appreciated, or solved by conventional lenses for charged particle beams. For example, some embodiments of the present invention pertain to variable-focus solenoidal lenses for charged particle beams, optionally with integrated emittance filtering. The emittance filtering in some embodiments is performed by one or more collimator plates that include respective collimating irises. The collimator plate(s) may be located external to and/or within the lens.

In an embodiment, an apparatus includes a first permanent ring magnet having a field oriented in a first direction and a second permanent ring magnet having a field oriented in a second direction that is opposite to the first direction. The first permanent ring magnet and the second permanent ring magnet each include an opening through which an electron beam can pass. In operation of the apparatus, the electron beam passes through the opening of the first permanent ring magnet and the opening of the second permanent ring magnet.

In another embodiment, a variable-focus magnetostatic lens includes a first permanent ring magnet having a field oriented in a first direction and a second permanent ring magnet having a field oriented in a second direction that is opposite to the first direction. The first permanent ring magnet and the second permanent ring magnet each include an opening through which an electron beam can pass. The variable-focus magnetostatic lens also includes a first collimator plate including a collimating iris that is positioned between the first permanent ring magnet and the second permanent ring magnet, or positioned outside of the first permanent ring magnet and or the second permanent ring magnet. The variable focus magnetostatic lens further includes a pair of magnetically permeable yokes. Each magnetically permeable yoke surrounds one of the first permanent ring magnet and the second permanent ring magnet. In operation of the variable-focus magnetostatic lens, the electron beam passes through the opening of the first permanent ring magnet, the opening of the second permanent ring magnet, and the collimating iris of the first collimator plate.

In yet another embodiment, a variable-focus magnetostatic lens with an adjustable focus and magnetic field strength includes a first permanent ring magnet having a field oriented in a first direction and a second permanent ring magnet having a field in a second direction that is opposite to the first direction. The first permanent ring magnet and the second permanent ring magnet each include an opening through which an electron beam can pass. The lens also includes a pair of magnetically permeable yokes, each magnetically permeable yoke surrounding one of the first permanent ring magnet and the second permanent ring magnet. The lens further includes a first collimator plate including a first collimating iris that is positioned between the first permanent ring magnet and the second permanent ring magnet, or positioned outside of the first permanent ring magnet and or the second permanent ring magnet.

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE EMBODIMENTS

Figure 1:
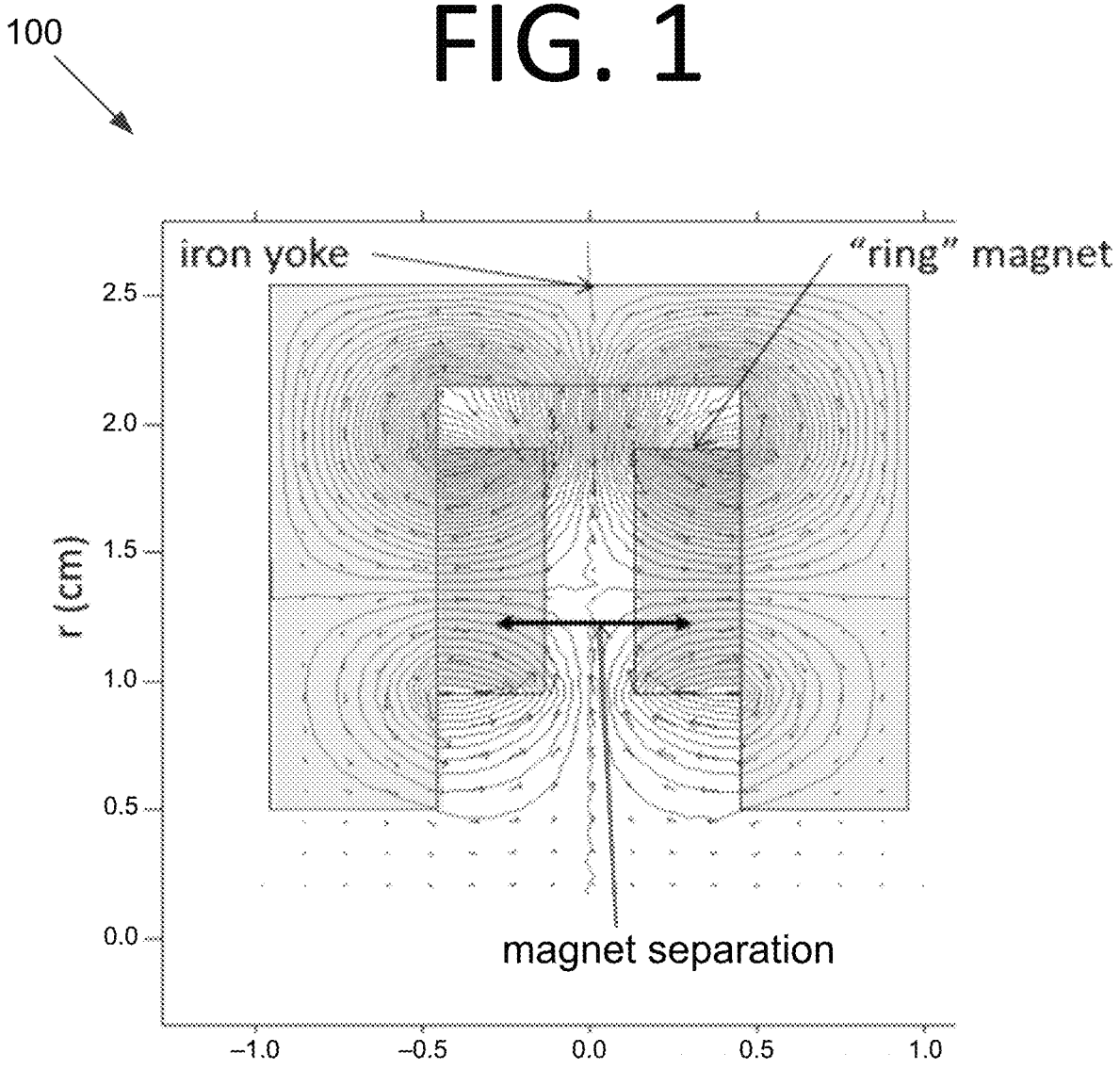
FIG. 1 is a Poisson calculation of a magnetic field of the lens, which includes an outer iron yoke and two inner ring magnets that oppose one another, according to an embodiment of the present invention.

Some embodiments of the present invention pertain to variable-focus solenoidal lenses for charged particle beams, with integrated emittance filtering. Some embodiments are relatively easy to fabricate and, while based on permanent magnets, can readily be modified to allow for remote control of the focal length. The emittance in some embodiments may be controlled via selection of collimating irises. The iris diameters may be fixed, locally adjustable, or remotely adjustable. In adjustable embodiments, the diameter of the iris may be modified by a motor or actuator that drives a shutter or another suitable mechanism. The focal length in some embodiments may be changed by altering the spacing between two permanent ring magnets. In certain embodiments, changes in spacing may be realized by one or more motors and/or actuators.

Some embodiments may be used for various vacuum and non-vacuum applications including, but not limited to, portable radiography machines, injection optics solutions for transport of a beam from a field-emitter cathode into a dielectric laser accelerator structure, lightweight and efficient accelerators where a relatively small amount of focusing is needed, x-ray systems for radiographic weld studies with an x-ray lens, spacecraft that perform spectroscopic analysis and chemical assays in deep space, megawatt class industrial accelerators with a thermionic cathode as an offset beam source, or for any other suitable application without deviating from the scope of the invention. Indeed, some embodiments may be used in any low to moderate energy charged particle transport beam system where permanent magnets are preferred, beam quality preservation is either noncritical or beam filtering is acceptable, and size and weight are at a premium.

Some embodiments facilitate focusing using unpowered permanent magnets. This has the advantage of not requiring power for focusing. Reducing or eliminating power consumption may be particularly beneficial for applications with limited power budgets, such as space missions. Due to the lack of powered focusing and a reduced number of components, some embodiments are also less likely to break than conventional lenses.

Some embodiments can be manufactured at a lower cost and smaller size than electromagnetic solenoids, and can also provide an in-situ adjustable focus. As another benefit, while a conventional solenoid design results in rotation of the electron beam as it is focused, some embodiments result in no net beam rotation. This is because while a field of a first permanent ring magnet rotates the beam in one direction, a field of a second permanent ring magnet, which is opposed in direction to the field of the first permanent ring magnet, rotates the beam in the opposite direction. Bringing these ring magnets closer together provides a weaker lens since the magnetic fields cancel one another out to some degree, and moving the magnets further apart provides a stronger lens since there is less cancellation.

Some embodiments may achieve approximately 90% of the desired performance for about 5% of the cost and with less than half the volume of an "ideal" magnetic lens design. Any cylindrically symmetric, time-independent focusing system for charged-particle beams, such as a simple magnetic solenoid or electrostatic Einzel lens, will exhibit spherical aberration, and thus, will degrade the beam quality to at least some extent. Going to an aberration-free system (e.g., an electron microscope column) would greatly increase complexity, size, and cost over solutions presented in some embodiments. Conventional permanent-magnet solenoids require sophisticated selection and placement of magnetic blocks, with the intention of reducing the spherical aberration to its physical minimum. Current-driven solenoids permit ready control of the focal length, but require a power supply and introduce heating and vacuum-compatibility concerns regarding the epoxies used to secure the solenoid coils while retaining the problem of spherical aberrations. Current-driven solenoids also cannot achieve the same short focal length as high-field permanent magnet designs in a comparably sized installation. In either case, an emittance filter would be required to control the beam quality since the spherical aberration results from the nature of the field, rather than the device generating the field.

Some embodiments may be employed in systems that use diamond field-emitter arrays (DFEAs) as cathodes for a dielectric laser accelerator (DLA). These DFEAs have the advantage of providing outstanding emittance, but at the cost of also producing a significantly divergent beam, with divergence measured at around 5 to 10 degrees. This divergence presents a focusing challenge, as the beam must be very tightly focused in order to be accepted into the DLA structure. The variable focus lens of some embodiments, which uses permanent-magnets in a solenoid like configuration to provide initial focusing of the beam, allows for relatively straightforward fabrication using commercially available components in order to provide a first-iteration solution for transporting the beam from the cathode to the DLA structure. The lens of some embodiments may also be used use with an electrostatic fixed-slit emittance measurement system.

Design

The focusing system of some embodiments is relatively easy to fabricate and implement, while still being robust enough to expand upon in the future. The focusing system may also produce a field strong enough to focus a strongly diverging beam. Two opposing permanent ring magnets are used in place of a solenoid in some embodiments. In practice, this allows a very portable structure to be assembled, which can still be adjusted with relative ease and has the potential for future remote adjustment capabilities for 'on the fly' focusing adjustments. The magnet design is illustrated in Poisson calculation 100 of FIG. 1.

More specifically, Poisson calculation 100 of FIG. 1 shows a magnetic field of the lens, which includes an outer iron yoke and two inner ring magnets that oppose one another. The focal length of the lens is varied by adjusting the separation between the ring magnets. Analytically, the focal length $f_{lens}$ of an axisymmetric magnetic lens may be expressed as:

$$f_{lens} := \left[\frac{q_e^2}{4\cdot(\beta\gamma\cdot c)^2\cdot m_e^2}\cdot\int_{min(z)}^{max(z)} B_s(s)^2 ds\right]^{-1} \quad (1)$$

where $q_e$ is the charge of a single electron, β is the normalized velocity of the electron relative to the speed of light, γ is the Lorentz factor, c is the speed of light, $m_e$ is the mass of the electron at rest, z is the distance along the lens axis, B is the axial magnetic field, and s is the distance along the axis of the lens used to calculate the integrated magnetic field through which the beam passes.

Figure 2:
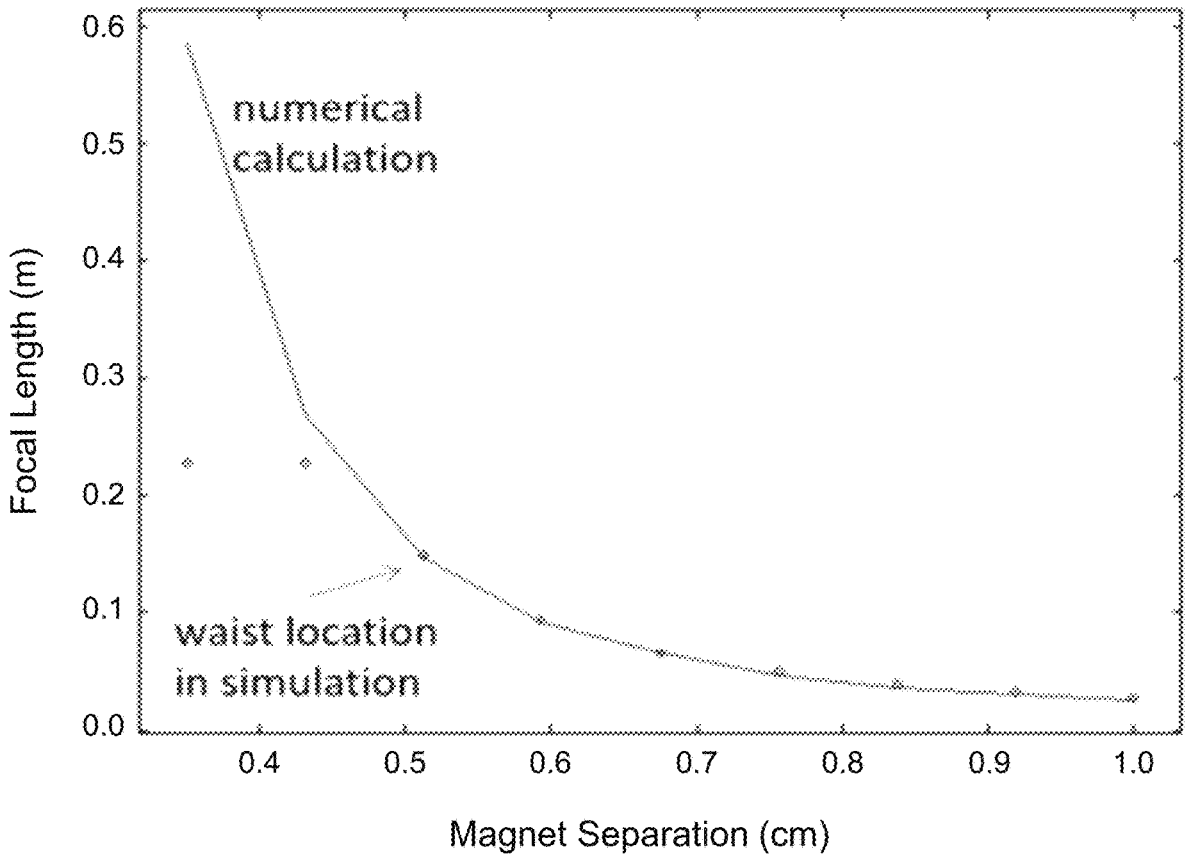
FIG. 2 is a graph illustrating a comparison between on-axis predicted focal length and particle tracking through a z-r field map, according to an embodiment of the present invention.
Figure 3:
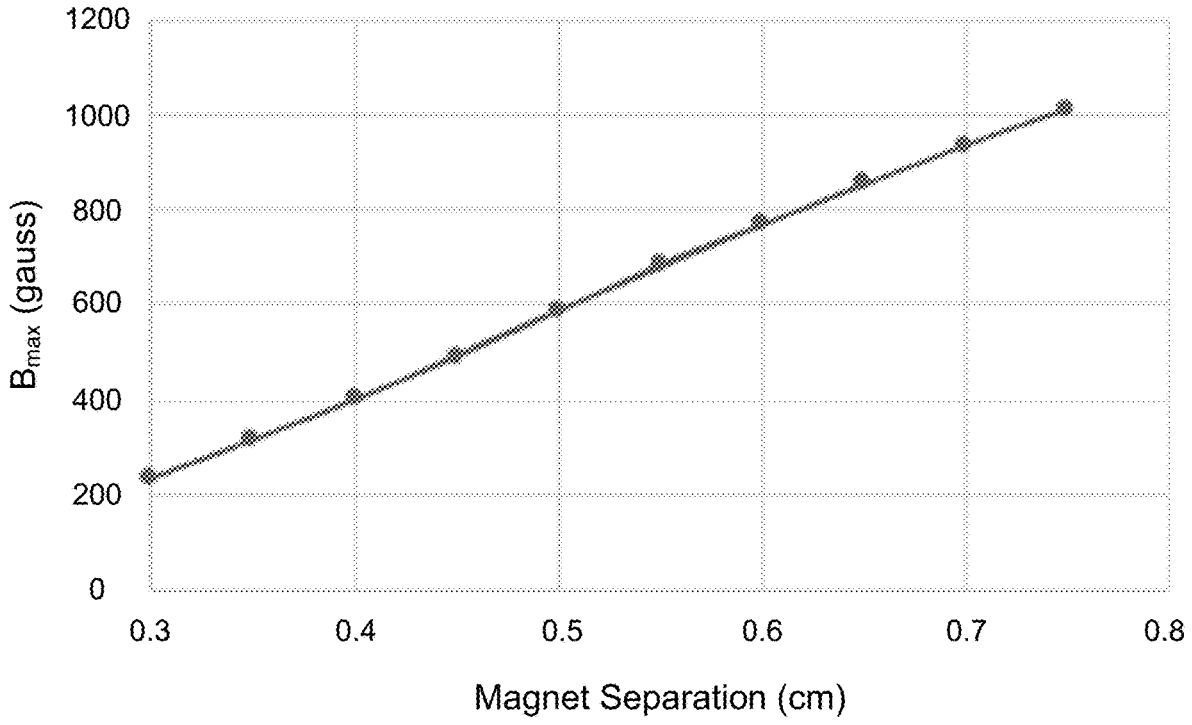
FIG. 3 is a graph illustrating the peak on-axis field as a function of the magnet separation, according to an embodiment of the present invention.

General Particle Tracer (GPT) by Pulsar Physics™ was used to simulate transport of an initially parallel beam through the lens using a two-dimensional (2D) cylindrically symmetric field map generated by POISSON, for comparison with the analytically calculated focal length using only the on-axis field. Simulations were performed at a beam voltage of 40 kV (yielding β=0.374 and γ=1.078 in Eq. (1) above). However, any suitable voltage may be used without deviating from the scope of the invention. Graph 200 of FIG. 2 shows a comparison between calculated and simulated focal length for a lens using the above interpolation function, while graph 300 of FIG. 3 shows the peak on-axis field as a function of the magnet separation. In FIG. 2, points off the curve do not indicate errors, but rather, that the focal point was outside the particle track boundary of GPT.

The next step in designing the lens of an embodiment was addressing the spherical aberration present in all axisymmetric magnetostatic focusing systems. Adding collimator disks into the system proved to be a straightforward and highly effective solution, providing two benefits to the lens as a whole. While copper, tungsten, or aluminum may be used as the collimator material in some embodiments, any suitable material may be used without deviating from the scope of the invention. The material (or materials) used to make the collimator should be: (a) non-magnetic; (b) electrically conductive; and (c) thick enough to stop any electron impacting the collimator from passing therethrough. First, the collimator disks reduced the effective spherical aberration in the lens (albeit by filtering, and thereby reducing the beam current). Second the collimator disks act as a basic emittance filter, which meets DLA requirements.

Figure 4:
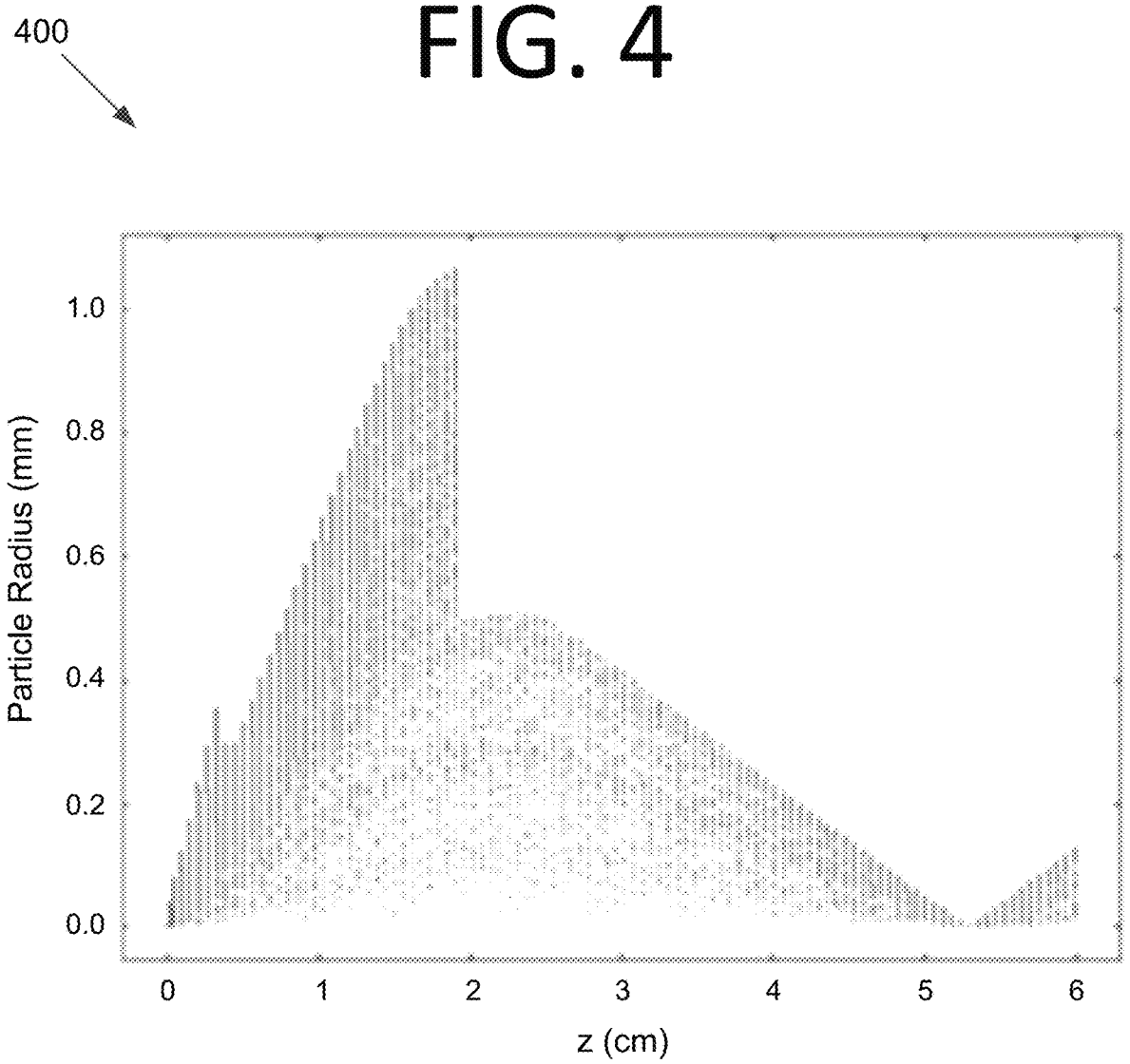
FIG. 4 is a graph illustrating a GPT simulation of beam propagation through the lens and two collimators, according to an embodiment of the present invention.

Further simulations indicated that with the additional collimators, the lens system should be able to get down to a 3-micron root mean square (RMS) beam size, approximately 6 cm from the cathode as shown in graph 400 of FIG. 4. The spot size can be reduced even further by adding an additional collimator plate after the lens assembly, albeit at the cost of reduced beam current. More lenses can be added to extend the beam transport line, but at the cost of beam quality degradation and required filtering.

Figure 5A:
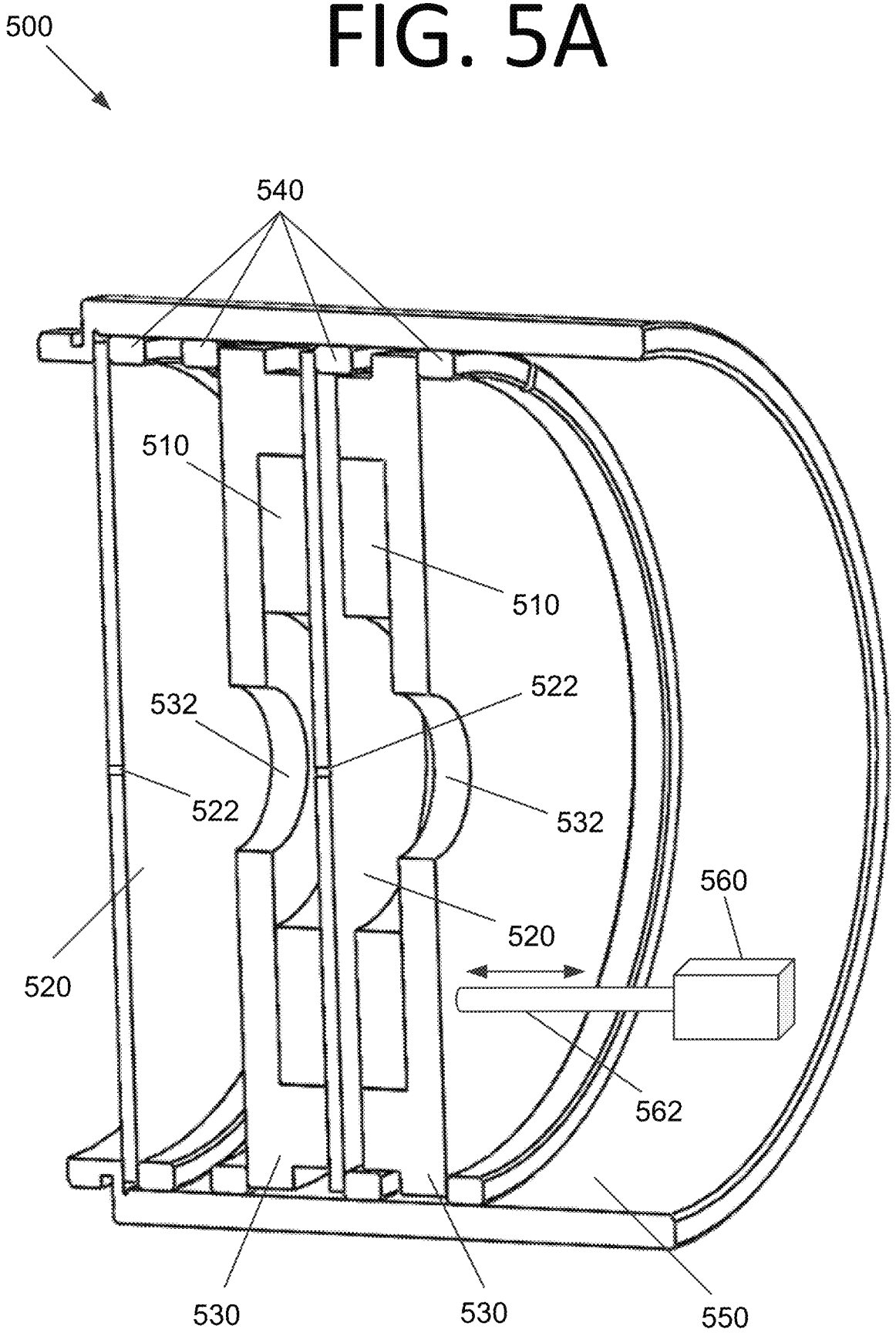
FIG. 5A is a side perspective view illustrating a variable-focus magnetostatic lens, according to an embodiment of the present invention.

FIG. 5A is a side perspective view illustrating a variable-focus magnetostatic lens 500, according to an embodiment of the present invention. Lens 500 includes a pair of permanent ring magnets 510 with opposing fields and a pair of collimator plates 520, with one being located in between ring magnets 510. Collimating irises 522 allows an electron beam to pass therebetween. In some embodiments, the diameter of collimating irises 522 may be adjustable. The diameters of collimating irises 522 may be different in certain embodiments.

It should be noted that an iris may be included on one or both of collimator plates 520 in some embodiments without deviating from the scope of the invention. In certain embodiments, collimator plates may be placed in different locations than those shown. Indeed, any number and/or location of collimator plates (including no collimator plates in some embodiments) may be used without deviating from the scope of the invention, so long as the collimator plates are positioned such that the electron beam passes through their respective irises. Irises would generally be included or not based on the particular requirements of a given system since the emittance would be set by the smallest iris relative to the beam size at the iris. For instance, in lens 500, collimator plate 520 would set a maximum value for the transmitted beam's emittance, and its respective iris 522, if variable, could be used to further reduce the emittance if desired or required.

A pair of yokes 530 made of a suitable material (e.g., iron (including vacuum-smelted iron), a thin amorphous metal alloy ribbon (e.g., Metglas®), a nickel-iron magnetic alloy (e.g., Permalloy), many varieties of steel (mostly, but not exclusively, non-stainless varieties), nickel, etc., or any combination thereof) each surround respective ring magnets 520 and hold them in place, in concert with retaining rings 540. A housing 550 (e.g., a lens tube) houses the other components of lens 500. The electron beam may travel through lens 500 from left to right with respect to FIG. 5.

However, it could also travel in the opposite direction and receive the same focusing since the lens is symmetric. An actuator 560 moves one permanent ring magnet 510 via a shaft 562. In some embodiments, multiple actuators/motors may be used to move one of the magnets. A magnet 510 may be moved by application of force directly to its respective iron yoke 530, by rotating a retaining ring 540 of one or both of magnets 510, by using a split lens tube 550, or via any other mechanism that achieves the desired separation without deviating from the scope of the invention. In certain embodiments, both magnets may be movable.

Figure 5B:
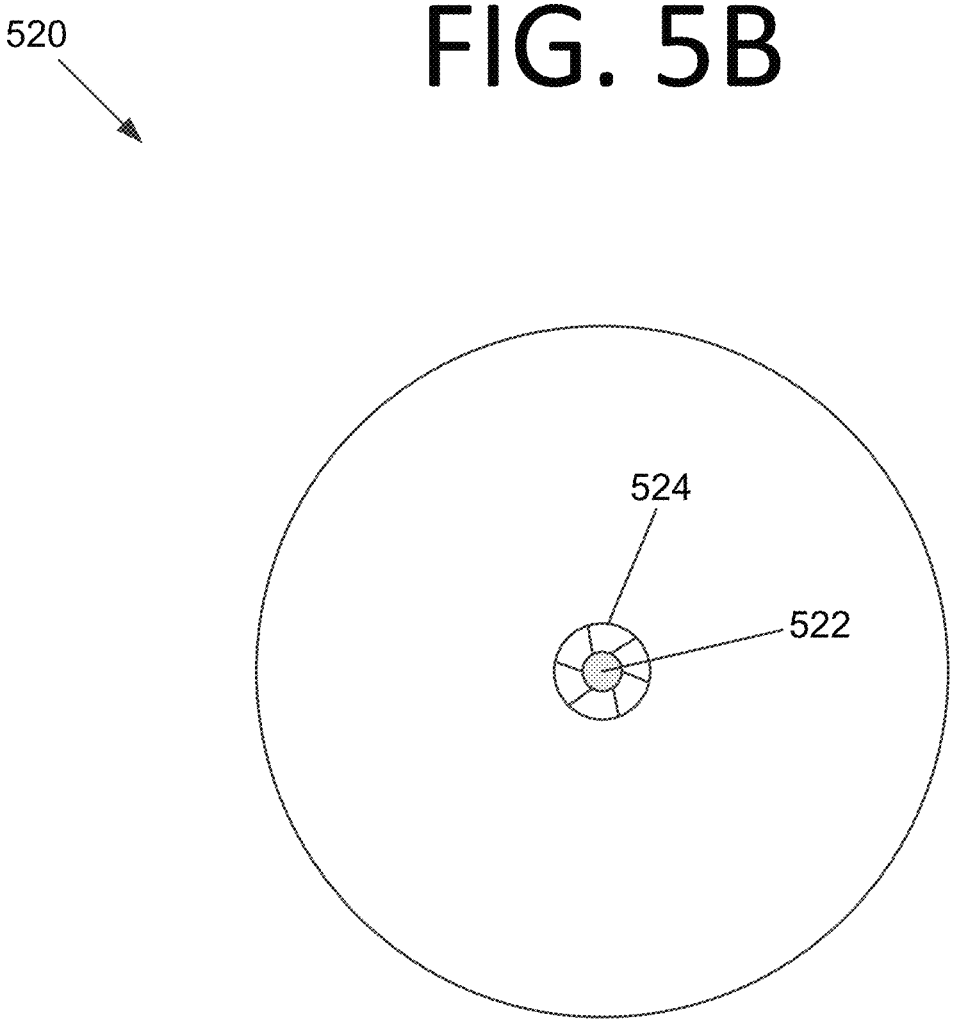
FIG. 5B is a front view illustrating a collimator plate, according to an embodiment of the present invention.

FIG. 5B is a front view illustrating a collimator plate 520, according to an embodiment of the present invention. Collimator plate 520 includes a collimating iris 522 and a shutter 524. The diameter of collimating iris 522 is adjustable via shutter 524.

Fabrication

The lens system of some embodiments should be implemented in such a way as to be relatively easy to procure, assemble, and adjust. In order to do this, commercially available parts may be used for certain parts. For instance, a lens tube, such as those provided by Thorlabs™, may be used as the support framework, which may also ensure that the entire lens can be mounted with ease on standard optics equipment. Indeed, in some embodiments, all lens components are commercially available, with the exception of the collimator plates and yokes, which can be manufactured by a machinist relatively inexpensively.

The magnet separation, and therefore focal length, may be adjusted by using a spanner wrench to adjust a retaining ring holding one magnet in position within the lens tube. As the magnets repel each other, their alignment is maintained as their separation is adjusted. The lens may be modified to allow the retaining ring to be motorized, or alternatively, the housing itself may provide a mechanism for adjusting the separation between the ring magnets. This adjustment may be controlled via software and allow remote adjustment of the focal length.

Initial Testing and Results

Figure 6:
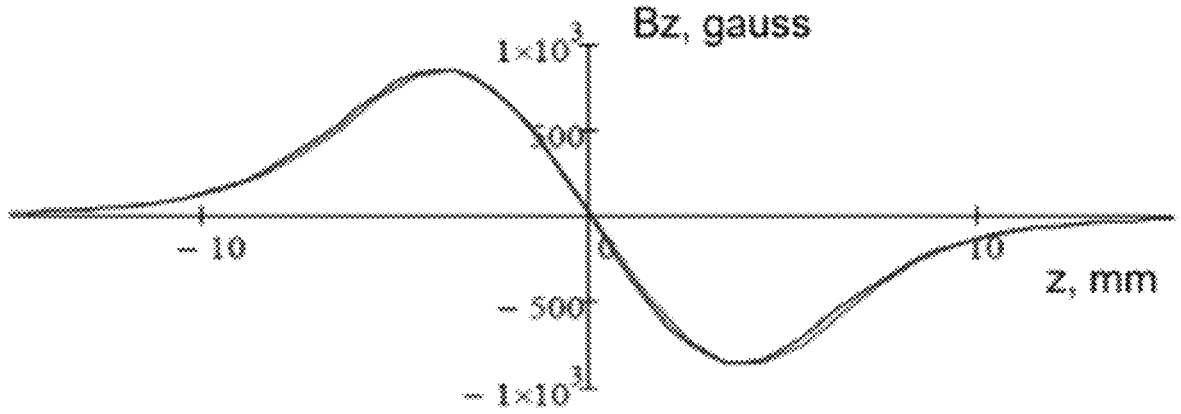
FIG. 6 is a graph illustrating a simulated field versus a measured field at various distances from the magnetic center, according to an embodiment of the present invention.

A prototype of an embodiment was constructed and tested. The lens was assembled and initially tested by using a Hall probe on to measure the magnetic field along the axis of the lens. The simulation result was then compared with the measured result. The comparison was done using Mathcad™, and is shown in graph 600 of FIG. 6. The line that deviates somewhat from the smooth curve is the measured field.

Figure 7:
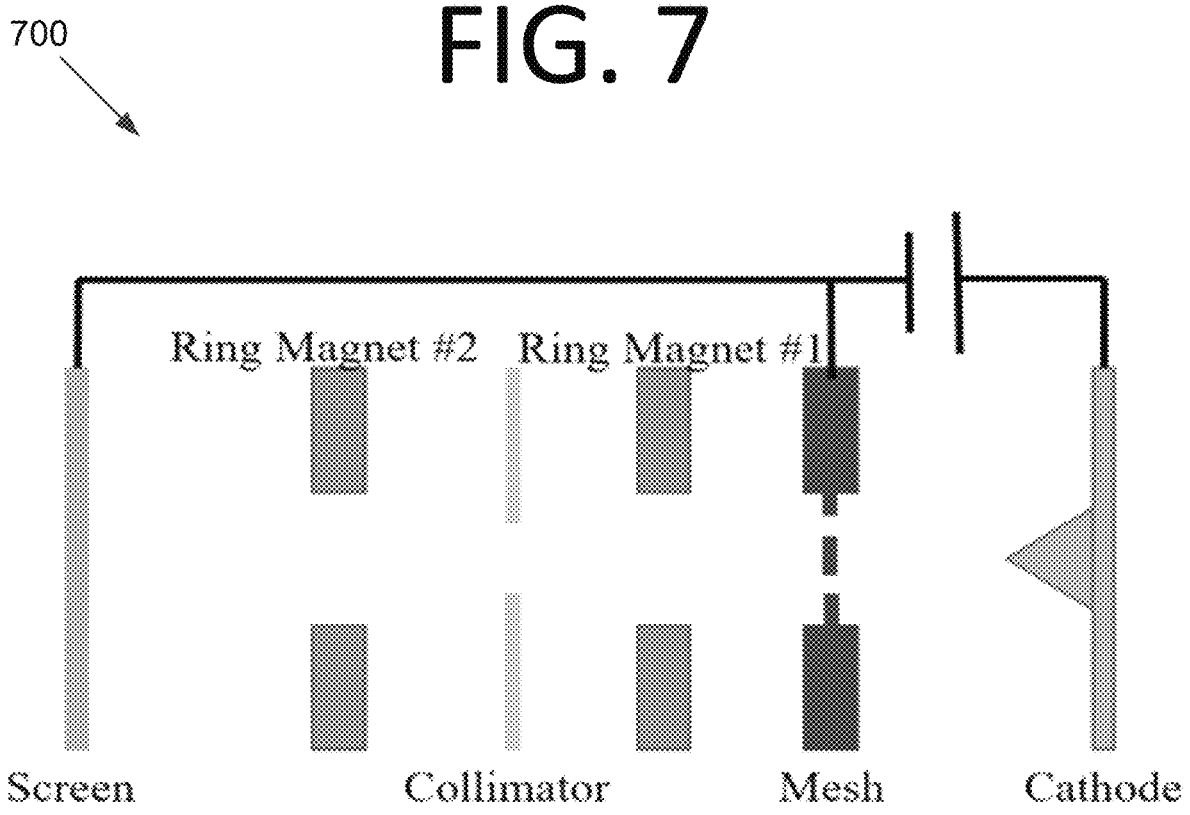
FIG. 7 is a schematic illustrating an experimental magnetic lens setup, according to an embodiment of the present invention.

The simulation and measurements match well and encouraged further testing the lens, as well as assembling the lens in the beamline for further measurements. A schematic of the experimental setup 700 is shown in FIG. 7. The iron yokes have been omitted for clarity. The spacing between the cathode and mesh, as well as the lens and mesh, is fixed. The spacing between the lens and the screen is variable, allowing screen to be moved through the focal point of the lens. This movement allows verification that the lens is focusing as expected and that moving out of the focal point will produce an unfocused beam.

For the initial test conditions for the lens, the magnets were set at a separation of 0.65 cm with a measured peak field of 950 gauss. The lens focal length was expected to be less than 2.89 cm, but more than 1.96 cm. The stage was moved from a distance of 4.14 cm to 1.55 cm from the magnetic center of the lens, covering the expected range of the focal length.

Figure 8:
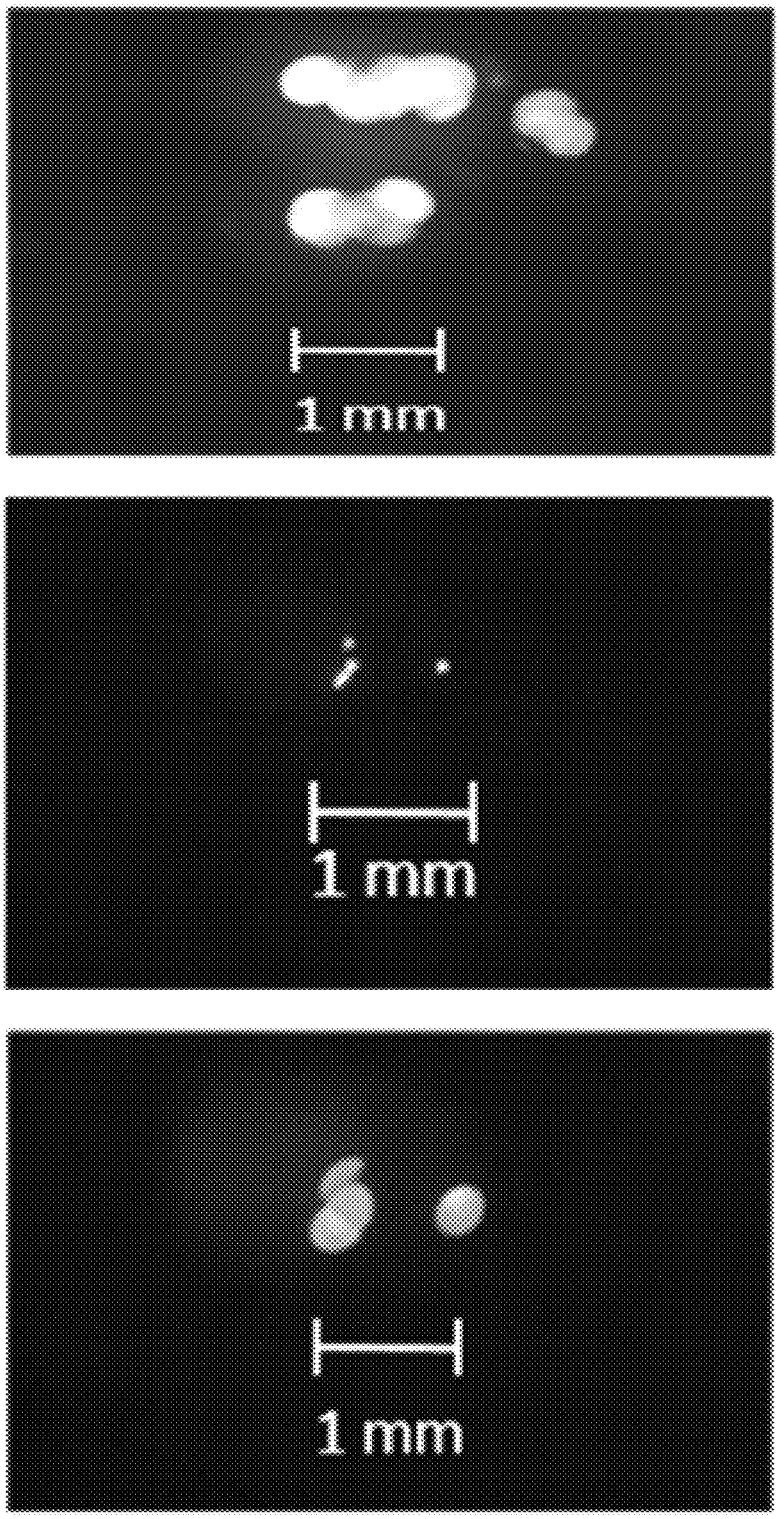
FIG. 8 illustrates a comparison between an unfocused beam without a lens (top image), the focused beam at 23.5 mm (middle image), and the unfocused beam at a distance of 30.5 mm (bottom image), where the focused beam has a spot size of 75 μm while the unfocused beam has a spot size of 197 μm, according to an embodiment of the present invention.

Images 800 of FIG. 8 show a comparison between an unfocused beam without a lens, a focused beam at 23.5, and the unfocused beam at a distance of 30.5 mm. The top image of FIG. 8 shows the results of the unfocused beam without the lens installed. The middle image shows the beam focusing at a distance of 2.35 cm. The spot size was measured by counting the pixels per millimeter of the image and resulted in a diameter of 75 μm when the lens screen was at the focal point of 2.35 cm. A beam current of 8.3 μA from screen to cathode was measured. The measured focal point agrees with the predicted focal point given the peak on-axis magnetic field and beam voltage. For comparison, at a distance of 3.05 cm from the lens, the beam is 197 μm across and has a transmitted current of 6.5 μA, as shown in the bottom image. The number of beam spots is reduced in the middle and bottom images, compared to the top image, due to the use of a collimator.

These tests indicate that the design and concept of the lens are effective and that with further fine tuning, it should be possible to come very close to the simulation results in production. In turn, this lays the groundwork for emittance measurement to be conducted using a 2-slit scanner. The spot size of 75 μm may be further reduced with refinement.

A variable focusing lens for field emitter cathodes has been designed, simulated, fabricated, and tested. The lens is relatively easy to implement, yet provides considerable flexibility in the experimental setup. A beam spot size of 75 μm was achieved. Further refinements to the physical implementation of the overall system will facilitate reaching a goal of approximately 3 micron RMS beam size. Such refinements may include, but are not limited to, improving the overall alignment of the lens to the cathode/anode plane, centering specific emitting pyramids on the axis, centering the anode mesh openings on-axis, and/or refining of the magnetic and collimator designs. Such steps should improve the accuracy of the emittance measurements and divergence studies, as well as facilitate achieving the goal of utilizing a dielectric laser accelerating structure.

Further Testing and Results

Further electron beam divergence and focusing lens studies from a single diamond emitter were conducted, the results of which are described below. For the divergence measurements, a test stand was designed and assembled that included a sparse diamond cathode, a mesh anode, and an AZO ($ZnO:Al_2O_3$) screen coated on a sapphire substrate. By assembling a focusing lens between the mesh and the screen, the diverging beam was focused onto a micrometer-scale spot size. The measured experimental results of the beam divergences and focusing lens are compared to the beam dynamic simulations.

Los Alamos National Laboratory (LANL) has recently established a capability to fabricate diamond array cathodes for electron beam sources. With nanometer size emitting areas (10-20 nm radius of tips) and high per-tip current (greater than 15 μA per-tip), diamond field emitter arrays (DFEAs) are promising cathodes for a dielectric laser accelerator (DLA). However, the large beam divergence may be a challenge to match a dielectric accelerator microstructure. Thus, this further testing was conducted to determine the electron beam's divergence angle and analysis of a small spot size using variable focusing lens in order to be focused on the DLA cavity structure.

Beam Divergence Measurement—Experimental and Simulation Setup

Figure 9:
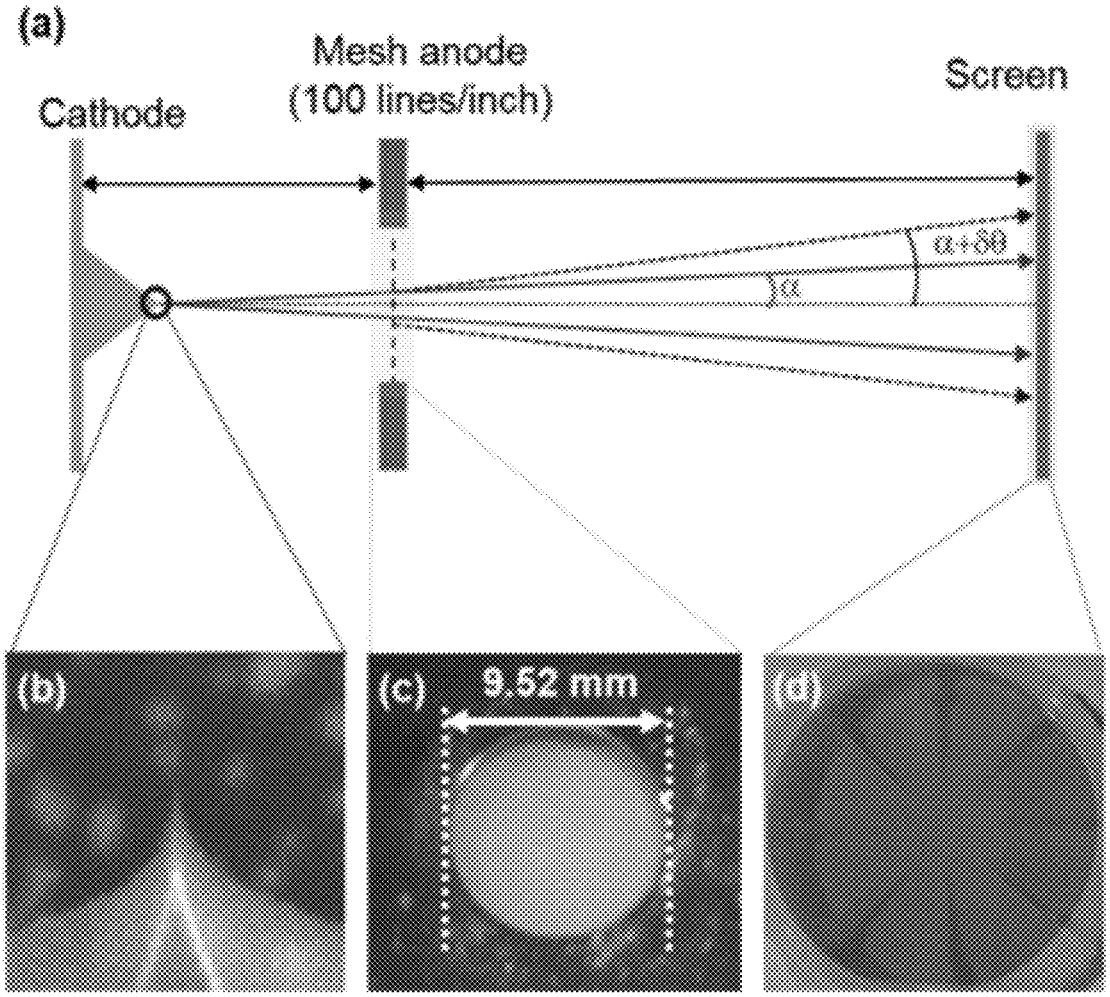
FIG. 9 illustrates an experimental setup for the beam divergence study that includes (a) a schematic of the experimental setup; (b) a diamond nanotip of a needle cathode; (c) a mesh anode; and (d) an AZO screen, according to an embodiment of the present invention.

FIG. 9 illustrates an experimental setup 900 for the beam divergence study that includes (a) a schematic of the experimental setup; (b) a diamond nanotip of a needle cathode; (c) a mesh anode; and (d) an AZO screen, according to an embodiment of the present invention. The fabricated diamond cathode has ~10 nm radius nanotips (see (b)) on the top of 20 μm base pyramids and is mounted on a cathode holder (shown as the thin rectangle to which the cathode is attached in (a)). A negative voltage of 40 kV was applied to the cathode. The mesh anode plate (see (c)) with an aperture diameter of 9.52 mm and a conductive AZO screen (see (d)) were mounted separately on movable stages. Both the mesh anode plate and the AZO screen were connected to ground through 20 kΩ resistors. The voltages were measured across the resistors to calculate the total emission current. Initially, the mesh anode was 15 mm from the cathode and was slowly brought close to the cathode to induce the field emission. The distance between the mesh anode and the screen was changed, the size of the beam on the screen was measured, and the divergence angle ($\alpha+\delta\theta$) was calculated.

Beam dynamics simulations were also conducted using Computer Simulation Technology (CST) Studio™ and General Particle Tracer™ (GPT) codes. Based on measured sizes of the fabricated pyramids, a 20 μm and 10 μm base single pyramid were simulated with a nanowire tip shape (250 nm height and 10 nm tip radius) and electrostatic fields were calculated with CST studio. The electric field profiles from CST Studio were imported to accelerate electrons in GPT, which were initially uniformly distributed along the hemisphere shape of 10 nm radius.

Beam Divergence Measurement—Experimental Results and Comparison to Simulation

Figure 10A:
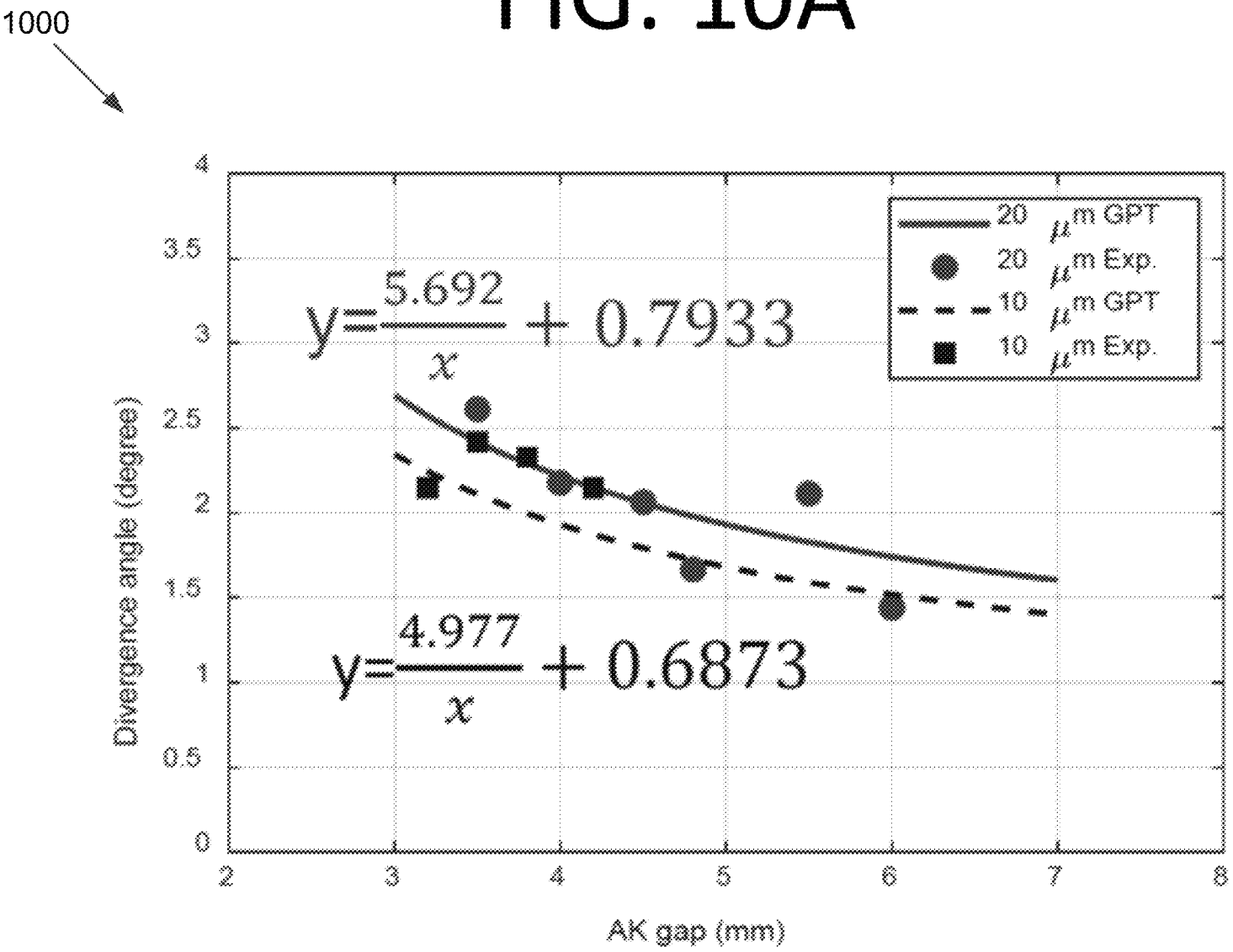
FIG. 10A is a graph illustrating measured and simulated divergence angles at different AK gaps and applied voltages, where the AK gap was varied from 3 to 6 mm and the applied voltage was fixed at 40 kV, according to an embodiment of the present invention. The General Particle Tracer (GPT) computer code was used to perform the beam divergence simulations.
Figure 10B:
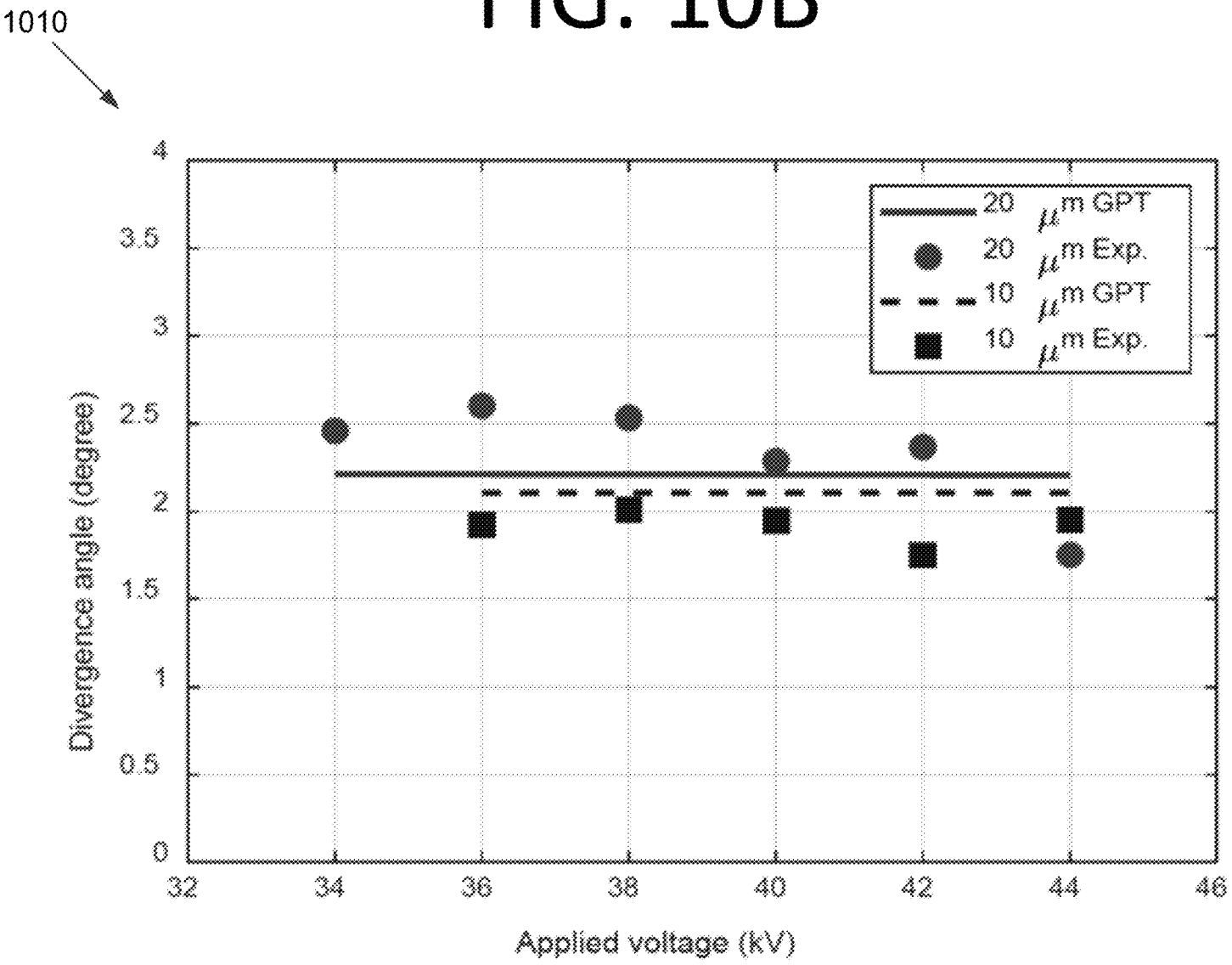
FIG. 10B is a graph illustrating measured and simulated divergence angles at different AK gaps and applied voltages, where for the 20 μm and 10 μm pyramids, the AK gap was fixed at 4 mm and 3.6 mm, respectively, while the applied voltage was varied, according to an embodiment of the present invention.

As shown in graph 1000 of FIG. 10A, the measured divergence angles were dependent on both the anode-cathode (AK) gap and the base size of the pyramids. The 10 μm and 20 μm base size pyramids were very similar in both the experimental measurements and the simulated results. Graph 1010 of FIG. 10B shows that the divergence angles remained the same with a constant AK gap and a changing applied voltage. In the simulation, the voltage between the anode and the cathode was increased to 100 kV, but nearly the same divergence angles were observed. This can be explained by the fact that the ratio of the transverse electric field to the longitudinal electric field is constant with a variation of the voltage.

Focusing Studies—Experimental and Simulation Setup

Figure 11:
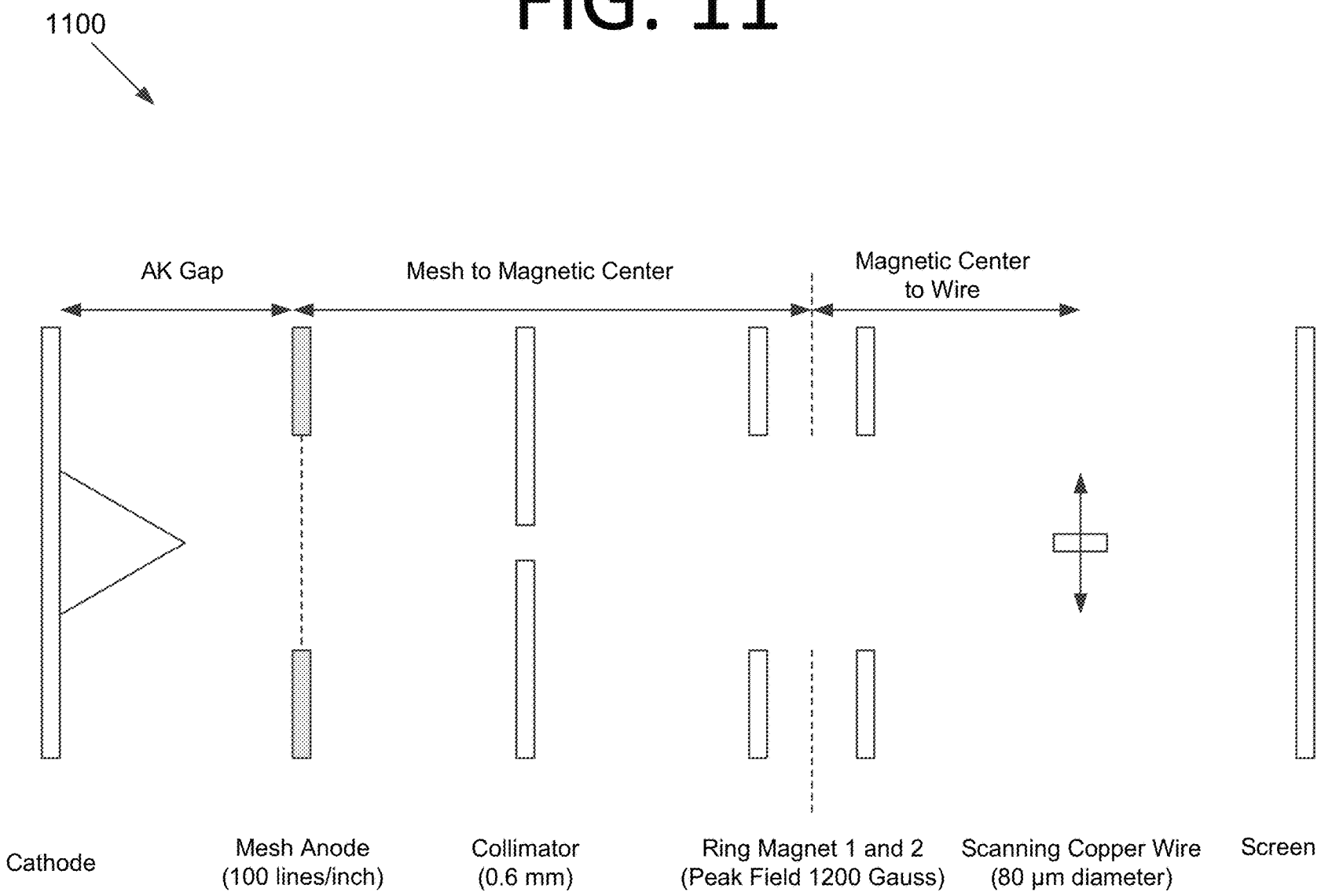
FIG. 11 is a schematic diagram illustrating the setup for the focusing studies, according to an embodiment of the present invention.

Once the beam divergence studies had been concluded, the experimental setup was then modified in order to develop a technique for focusing the beam to a small spot size of only several μm. The schematic of the focusing experimental setup 1100 is shown in FIG. 11. The copper wire is relatively thin at only 80 μm in diameter.

Similar to the divergence studies, the experiment included applying a negative voltage of 40 kV to the cathode. In this case, the mesh screen is mounted on a separate stage, the magnetic lens is mounted in a fixed position after the screen, and the copper wire and AZO screen are mounted on an additional stage. It should be noted that the AZO screen and the copper wire are electrically isolated from each other, which allows measurement of the current collected by the wire across a 20 kΩ resistor separately from the current deposited on the screen.

The reason for utilizing a wire scanning technique as opposed to measuring the spot size directly on the AZO screen is a matter of resolution. Previously, it was possible to measure a spot size of approximately 10 μm on the screen, but it could not be determined whether the beam was any smaller than that due to the limited resolution of the camera. Instead, by measuring the voltage on the copper wire as it was moved across the beam horizontally, it was possible to determine the size of the spot with much finer resolution that is instead limited by the resolution of the stage, and not by the resolution of the camera and the AZO screen. The stage has a resolution of approximately 200 nm.

Figure 12:
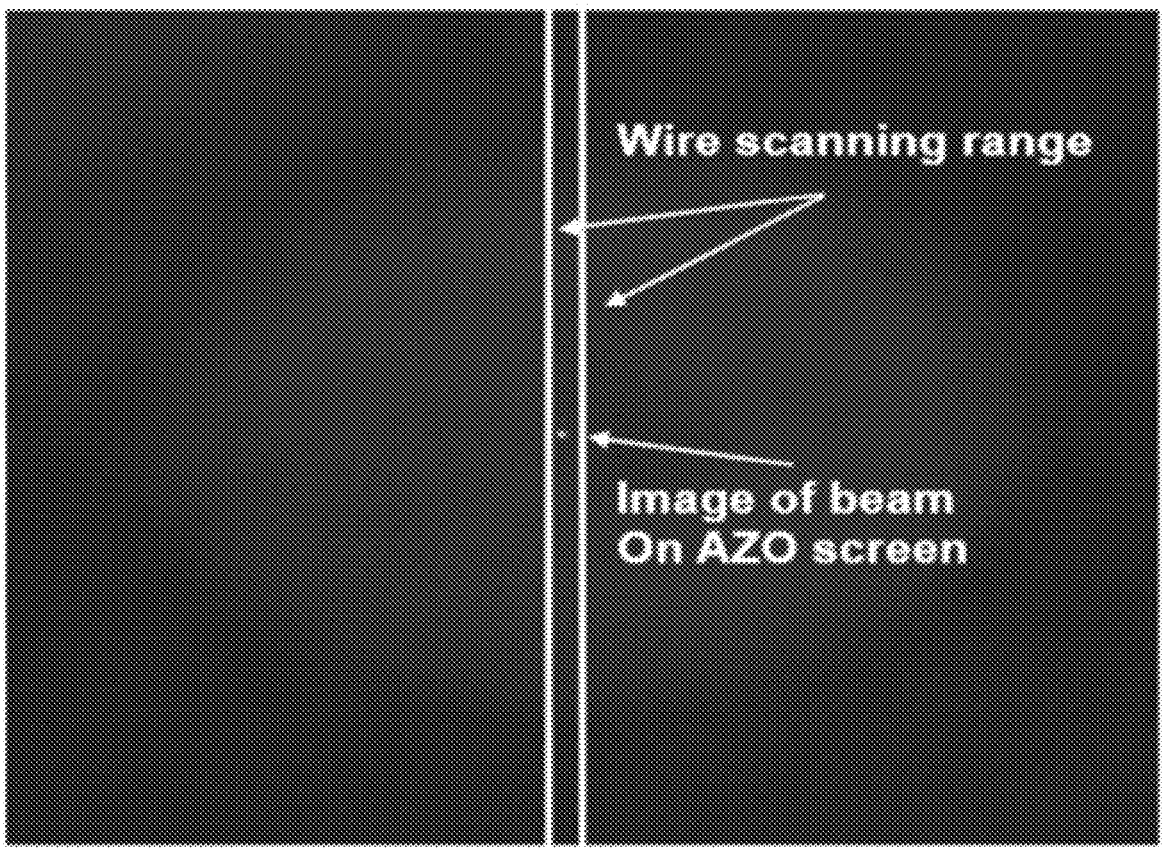
FIG. 12 is a snapshot illustrating the electron beam at a distance of 16 mm from the magnetic center of the lens, where the white bars indicate the wire scanning range, according to an embodiment of the present invention.

Snapshot 1200 of FIG. 12 illustrates the beam on the AZO screen positioned at a distance of 16 mm from the magnetic center of the focusing lens. This image was used to determine the location of interest for the wire scan to take place. The two vertical white bars show the area that the wire scanned. Scanning was then performed from left to right for a distance of 0.5 mm at an increment of 1 μm. Ten data points were collected at each location along this scan, and those data points were averaged together. This averaging was done in order to correct for the observed fluctuations in cathode current. The experimental parameters for the focusing test are provided in Table I below.

TABLE I

EXPERIMENTAL PARAMETERS

| Experimental Parameter: | Value: |
|---|---|
| AK Gap | 3.9 mm |
| Mesh to Wire Distance | 67.19 mm |
| Magnet to Wire Distance | 16 mm |
| Pyramid Base | 8.3 μm |
| Pyramid Spacing | 400 μm |
| Measured Spot Size | 5.72 μm |
| Peak Magnetic Field | 1200 Gauss |
| Measured Average Voltage | 0.3156 V |
| Measured Average Current | 15.78 μA |

Additional beam dynamics simulations were then conducted using the same CST code electric field profiles, and these were imported into GPT. The magnetic field of the lens was generated using POISSON™, and this was also imported into GPT in order to simulate focusing and calculate the expected focal point, as well as the expected spot size of the beam.

Focusing Studies—Experimental Results and Comparison to Simulation

Figure 13:
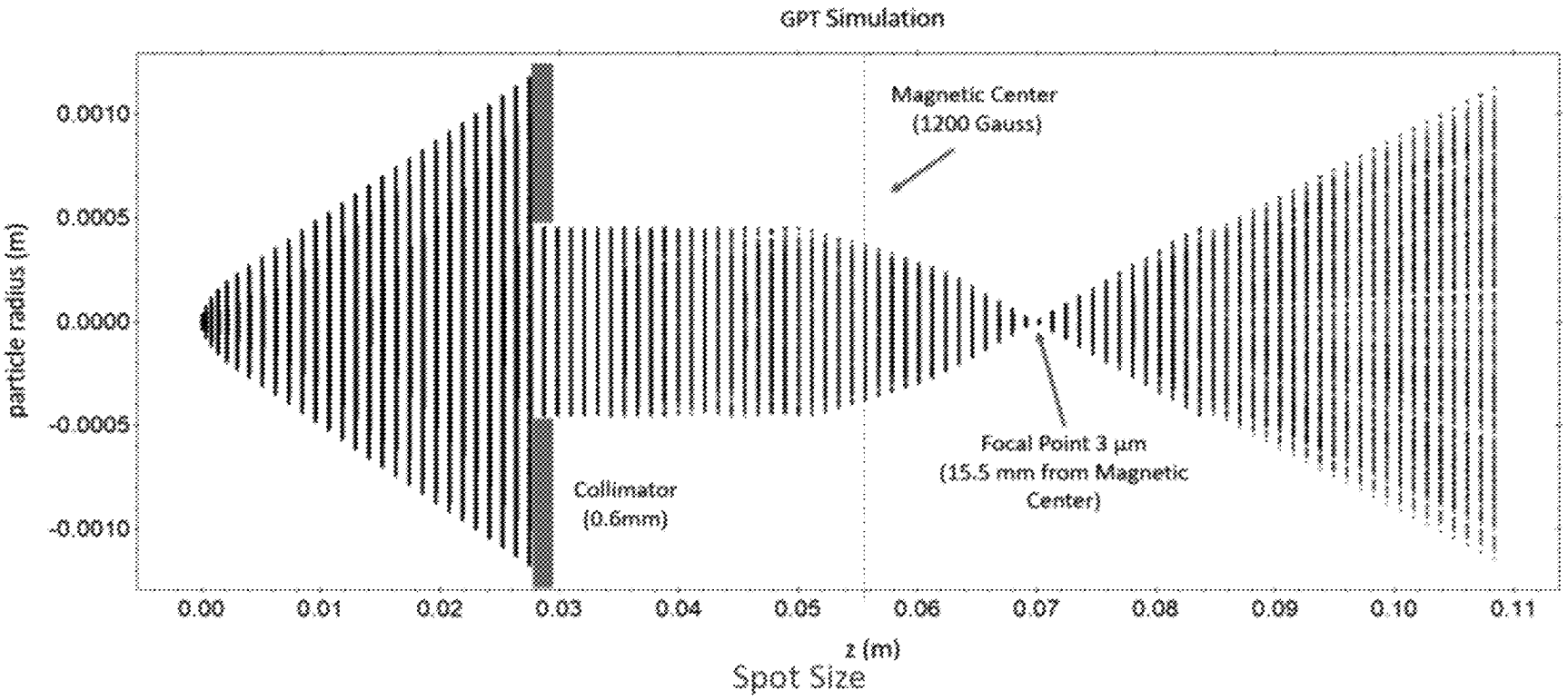
FIG. 13 is a GPT simulation of the beam converging to a 3 μm spot size at a distance of 15.8 mm from the magnetic center, according to an embodiment of the present invention.
Figure 14:
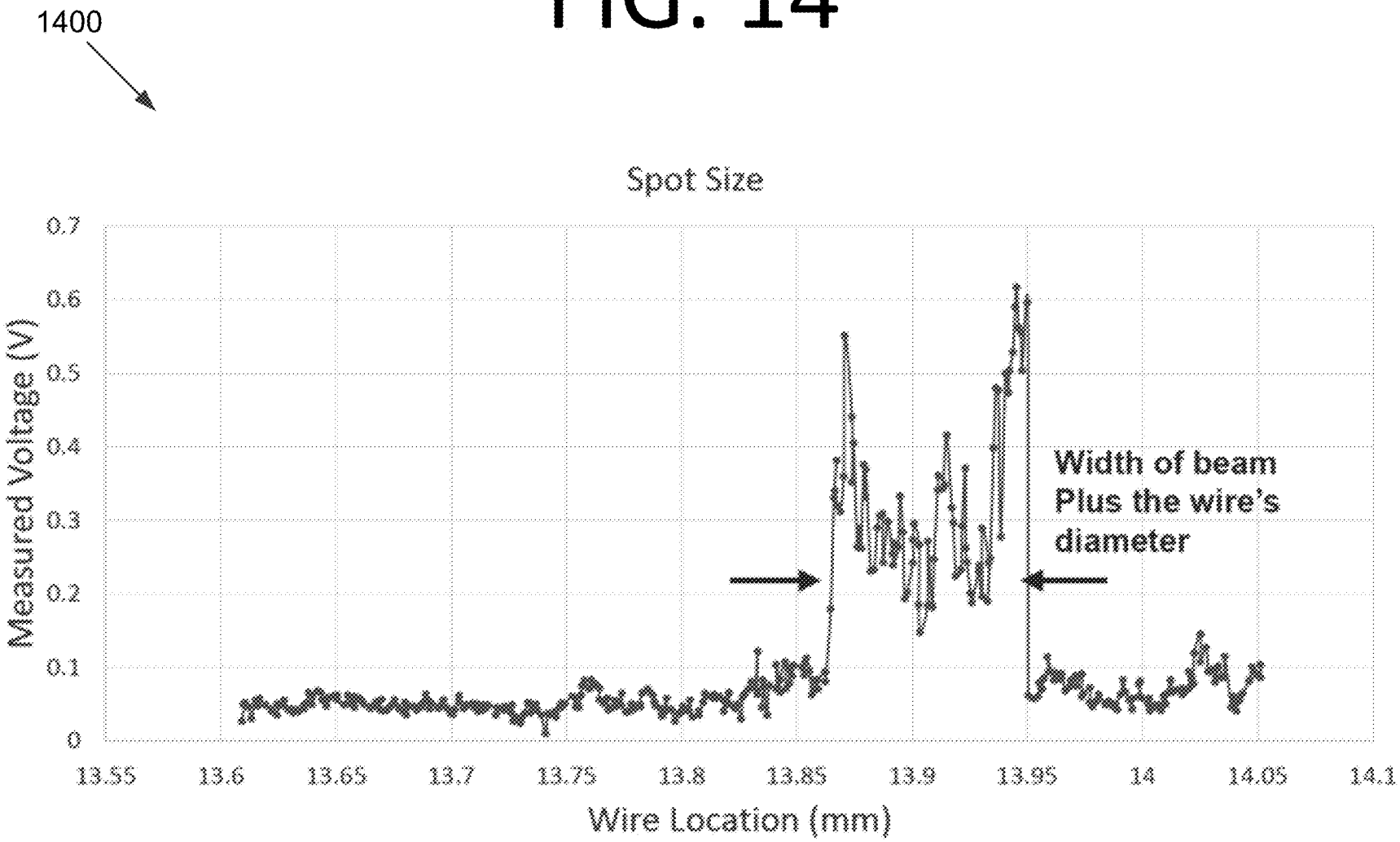
FIG. 14 is a graph illustrating the measured voltage on the copper wire versus the location of the wire, showing a spot size of 5.72 μm, according to an embodiment of the present invention.

The simulation results shown in GPT simulation 1300 of FIG. 13 predicted that the beam will be focused at a distance of 15.8 mm from the magnetic center with a spot size of 3 μm. This is in good agreement with the experimentally measured spot size in graph 1400 of FIG. 14. More specifically, FIG. 14 shows the results of scanning the 80 μm wire across the beam. The voltage was measured on the wire when it overlapped with the beam, giving a spot size of 5.72 μm. The difference between the simulation value and the measured value can most likely be attributed to small misalignments in the experiment, as well as a lack of precise uniformity in the diameter of the copper wire. It is also possible that the wire was vibrating as the stage was moving, which could be distorting the results. It should be noted that the two "peaks" appear in FIG. 14 on either end of the measurement. These peaks require further study and analysis in order to determine whether they are real or are merely abnormalities generated by the measurement process.

Per the above, diamond field emitter array cathodes have been designed and tested in divergence and focusing studies. First, the electron beam divergence studies were performed using two cathode samples. As the AK gap increased with fixed voltage, measured divergence angles decreased, which was in good agreement with simulations. The divergence angles were constant even when the applied voltage was varied for the constant gap.

A relatively simple focusing lens was then added in order to measure and study the effects of focusing the diverging beam to a point small enough to enter a DLA. In order to measure this effect, a wire scanning technique was used rather than a screen. This wire scanning technique allowed measurement of a spot size of 5.72 μm. This result agrees with simulations from GPT, but is not yet ideal. Additional measurements and adjustments to the experimental setup should be made in order to further refine the resolution of the spot size measurement. This refinement can take place by further increasing the mechanical alignment of the experimental setup, as well as decreasing the diameter of the wire used to perform the test and further characterizing any change in the diameter and jitter of that wire.

It will be readily understood that the components of various embodiments of the present invention, as generally described and illustrated in the figures herein, may be arranged and designed in a wide variety of different configurations. Thus, the detailed description of the embodiments of the present invention, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, reference throughout this specification to "certain embodiments," "some embodiments," or similar language means that a particular feature, structure, or characteristic described in connection with the embodiment is included in at least one embodiment of the present invention. Thus, appearances of the phrases "in certain embodiments," "in some embodiment," "in other embodiments," or similar language throughout this specification do not necessarily all refer to the same group of embodiments and the described features, structures, or characteristics may be combined in any suitable manner in one or more embodiments.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. An apparatus, comprising:

a first permanent ring magnet generating a field oriented in a first direction and a second permanent ring magnet generating a field oriented in a second direction that is opposite to the first direction, the first permanent ring magnet and the second permanent ring magnet each comprising an opening through which an electron beam can pass; and a first collimator plate comprising a collimating iris that is positioned between the first permanent ring magnet and the second permanent ring magnet, or positioned outside of the first permanent ring magnet and or the second permanent ring magnet, wherein in operation of the apparatus, the electron beam passes through the opening of the first permanent ring magnet and the opening of the second permanent ring magnet.

2. The apparatus of claim 1, wherein emittance of the apparatus is controlled by a diameter of the collimating iris of the first collimator plate, and the diameter of the collimating iris is fixed, locally adjustable, or remotely adjustable.

3. The apparatus of claim 1, wherein the diameter of the collimating iris is locally adjustable or remotely adjustable, and the first collimating plate comprises an adjustable shutter, the adjustable shutter configured to control the diameter of the collimating iris.

4. The apparatus of claim 1, further comprising:

a pair of magnetically permeable yokes, each magnetically permeable yoke surrounding one of the first permanent ring magnet and the second permanent ring magnet.

5. The apparatus of claim 4, further comprising:

a first collimator plate comprising a collimating iris that is positioned between the first permanent ring magnet and the second permanent ring magnet; and a second collimator plate located outside of the pair of magnetically permeable yokes, the second collimator plate comprising a collimating iris.

6. The apparatus of claim 4, further comprising:

a plurality of retaining rings that hold the first permanent ring magnet and the second permanent ring magnet in place in concert with the magnetically permeable yokes.

7. The apparatus of claim 1, wherein a distance between the first permanent ring magnet and the second permanent ring magnet is adjustable such that a strength of an overall field generated by the apparatus decreases when the first permanent ring magnet and the second permanent ring magnet are moved closer together due to cancellation of the respective, opposing fields of the first permanent ring magnet and the second permanent ring magnet, and the strength of the overall field generated by the apparatus increases when the first permanent ring magnet and the second permanent ring magnet are moved further apart.

8. The apparatus of claim 1, wherein a focal length is of the apparatus is controlled by a distance between the first permanent ring magnet and the second permanent ring magnet.

9. The apparatus of claim 1, wherein the apparatus does not require power.

10. The apparatus of claim 1, wherein a net rotation of less than 1% is realized in the electron beam when the apparatus is in operation.

11. A variable-focus magnetostatic lens, comprising:

a first permanent ring magnet generating a field oriented in a first direction and a second permanent ring magnet generating a field oriented in a second direction that is opposite to the first direction, the first permanent ring magnet and the second permanent ring magnet each comprising an opening through which an electron beam can pass; and a pair of magnetically permeable yokes, each magnetically permeable yoke surrounding one of the first permanent ring magnet and the second permanent ring magnet, wherein in operation of the variable-focus magnetostatic lens, the electron beam passes through the opening of the first permanent ring magnet and the opening of the second permanent ring magnet.

12. The variable-focus magnetostatic lens of claim 11, wherein the magnetically permeable yokes are not in direct contact with one another.

13. The variable-focus magnetostatic lens of claim 11, further comprising:

a collimator plate located outside of the pair of magnetically permeable yokes, the collimator plate comprising a collimating iris.

14. The apparatus of claim 11, further comprising:

a plurality of retaining rings that hold the first permanent ring magnet and the second permanent ring magnet in place in concert with the magnetically permeable yokes.

15. The variable-focus magnetostatic lens of claim 11, wherein a distance between the first permanent ring magnet and the second permanent ring magnet is adjustable such that a strength of an overall field generated by the apparatus decreases when the first permanent ring magnet and the second permanent ring magnet are moved closer together due to cancellation of the respective, opposing fields of the first permanent ring magnet and the second permanent ring magnet, and the strength of the overall field generated by the apparatus increases when the first permanent ring magnet and the second permanent ring magnet are moved further apart.

16. The variable-focus magnetostatic lens of claim 11, further comprising:

a collimator plate comprising a collimating iris that is positioned between the first permanent ring magnet and the second permanent ring magnet, or positioned outside of the first permanent ring magnet and or the second permanent ring magnet, wherein a focal length is of the apparatus is controlled by a distance between the first permanent ring magnet and the second permanent ring magnet, and emittance of the variable-focus magnetostatic lens is controlled by a diameter of the collimating iris of the first collimator plate.

17. The variable-focus magnetostatic lens of claim 16, wherein the diameter of the collimating iris is locally adjustable or remotely adjustable, and the collimating plate comprises an adjustable shutter, the adjustable shutter configured to control the diameter of the collimating iris.

18. A variable-focus magnetostatic lens with an adjustable focus and magnetic field strength, comprising:

a first permanent ring magnet generating a field oriented in a first direction and a second permanent ring magnet generating a field oriented in a second direction that is opposite to the first direction, the first permanent ring magnet and the second permanent ring magnet each comprising an opening through which an electron beam can pass;

a pair of magnetically permeable yokes, each magnetically permeable yoke surrounding one of the first permanent ring magnet and the second permanent ring magnet; and a first collimator plate comprising a first collimating iris that is positioned between the first permanent ring magnet and the second permanent ring magnet, or positioned outside of the first permanent ring magnet and or the second permanent ring magnet.

19. The variable-focus magnetostatic lens of claim 18, further comprising:

a second collimator plate comprising a second collimating iris located outside of the pair of magnetically permeable yokes;

a plurality of retaining rings that hold the first permanent ring magnet, the second permanent ring magnet, and the first collimator plate in place in concert with the magnetically permeable yokes; and a housing that houses components of the variable-focus magnetostatic lens.

* * * * *